United States Patent [19]

Grabner et al.

[11] Patent Number: 4,568,066

[45] Date of Patent: Feb. 4, 1986

[54] APPARATUS FOR INTRODUCING GAS TO MOLTEN METAL

[75] Inventors: Bernd Grabner, Radenthein, Austria; Hans Höffgen, Höhr-Grenzhausen, Fed. Rep. of Germany

[73] Assignee: Österreichisch Amerikanische Magnesit Aktiengesellschaft, Kärnten, Austria

[21] Appl. No.: 539,750

[22] Filed: Oct. 6, 1983

[30] Foreign Application Priority Data

Oct. 6, 1982 [AT] Austria ..... 3692/82

[51] Int. Cl.[4] ..... C21C 5/34

[52] U.S. Cl. ..... 266/220; 266/224

[58] Field of Search ..... 266/217, 218, 219, 220, 266/224, 265, 266

[56] References Cited

U.S. PATENT DOCUMENTS

| | | | |
|---|---|---|---|
| 3,490,755 | 1/1970 | Lutgen | 266/220 |
| 3,610,602 | 10/1971 | Deacon et al. | 266/220 |
| 4,340,208 | 7/1982 | Vayssiere et al. | 226/220 |
| 4,396,179 | 8/1983 | Labate | 266/217 |

FOREIGN PATENT DOCUMENTS

| | | | |
|---|---|---|---|
| 1458806 | 6/1964 | Fed. Rep. of Germany . | |
| 2451945 | 3/1979 | France . | |
| 2096290 | 10/1982 | United Kingdom | 266/265 |

*Primary Examiner*—L. Dewayne Rutledge
*Assistant Examiner*—Robert L. McDowell
*Attorney, Agent, or Firm*—Finnegan, Henderson, Farabow, Garrett & Dunner

[57] ABSTRACT

A scavenger for injecting gas into molten material where a refractory member fits within an opening in a refractory lining. The cold face of the scavenger fits within a recess of a base that includes a gas conduit in the form of a double spiral. The gas conduit in the base is in flow communication with the gas transmitting means in the gas scavenger.

14 Claims, 2 Drawing Figures

APPARATUS FOR INTRODUCING GAS TO MOLTEN METAL

FIELD OF THE INVENTION

The invention is directed to a metallurgical furnace or to a metallurgical container for handling molten metal, having at least one gas scavenger disposed in its refractory lining, normally in its base.

BACKGROUND OF THE INVENTION

Recently there has been wide use of gas-permeable molded refractory bodies, generally termed as gas scavengers, for injecting various gases through the refractory lining into metallurgical furnaces and containers in connection with processing of molten metals. These gas scavengers are normally located in the base, especially in converters for refining of crude [pig] iron; in pig-iron ladles; casting ladles, and tundishes used in continuous casting of steel. They may also be built into all these units and also into the lining of the lateral walls of other metallurgical furnaces and containers, for instance into electric arc furnaces. In all these cases the gas scavengers should meet the requirement that their durability be not less than that of the adjacent refractory lining in the furnace or container, so that downtime caused by a premature wear of such gas scavengers can be avoided or at least minimized. To meet this requirement, two principal alternatives are available. One is the improvement of the characteristics of the refractory material used in the construction of the gas scavengers; the other is the improvement in the construction of the scavengers. The present invention is directed to the second alternative.

Various attempts have already been made to improve the durability of the gas scavengers, which are generally disposed in a ventilated brick. For instance, a gas scavenger is known which is lined on its lateral walls and on its base with sheet metal. Metal plates extend through its interior. The end opposite from the interior of the furnace or container (the cold end) constitutes the base of the scavenger, and includes a gas injection pipe for conducting gas through the scavenger into the melt to be treated. On this gas conduit pipe there is attached a spiral-shaped pipe for conducting the scavenging gas. The gas conduit pipe and the spiral-shaped pipe are embedded in a sintered refractory material (FR-OS No. 24 51 945). The spiral-shaped pipe in this construction is supposed to solidify the melt on the pipe. This reduces wear of the gas scavenger and damage to the sheet metal at the hot end of the gas scavenger. This also prevents flow of molten material into the ventilated brick, and by the solidification of a portion of the melt prevents any further flow from the metallurgical furnace or container. This type of known gas scavenger, however, has the disadvantage, that it is not readily replaceable. This results in interruption of the production of the furnace or container, because, in spite of precautions taken, such scavengers are subject to faster wear than the adjacent refractory lining.

One object of invention is to provide a safety system for metallurgical furnaces and containers, which precludes the possibility of a break-through of the melt through a gas scavenger. A further object of the invention is to facilitate the simple replacement of such a gas scavenger. This was found to be possible when the gas scavenger is constructed in a special manner together with a block of refeactory material in a refractory lining, and further, when the conduit pipe for feeding the processing gases for the melt to the gas scavenger is constructed in a special manner. Accordingly, the invention is directed to a metallurgical furnace or a metallurgical container for handling of molten metal, having at least one gas scavenger disposed in its refractory lining, preferably at the base. The end of the gas scavenger distant from the interior of the furnace or container (the gas scavenger base) has a gas conduit pipe therein and a spiral-shaped pipe for conducting the scavenging gas is connected to it. The base of the gas scavenger is set into a recess of a base block of refractory material. Preferably, the pipe system in the base block is spirally-shaped and is constructed from a double, partially vertical convoluted pipe embedded in the block-like base.

A preferred embodiment of the invention has the gas scavenger, with its base in a recess in a base block, it being secured with a refractory mortar or cement constructing a labyrinth-type seal. Thus, any further breakthrough of molten metal, which may have penetrated between the gas scavenger and the immediate surrounding refractory lining or between the gas scavenger and the sheet metal mantle encasing it, can be prevented. Generally, it is practical to dispose the gas scavenger in a ventilated brick. In case the melt reaches the gas conduit pipe, it must then rise upwards in the double, partially vertical convoluted portions of the pipe. The melt will not rise into the vertical portions of the pipe, but rather will solidify therein. This solidification is promoted by the configuration of the double spiral pipe system. The flow of the melt into each portion of the double spiral is divided, and this divides the heat of the melt and increases its surface area so that the metal solidifies at a faster rate than molten metal passing through a single conduit. The increased solidification rate and the resistance to flow provided by the vertical portion of the double spiral combines to effectively inhibit the flow of the melt as it rises in the vertical portions of the double spiral conduit. The solidification of the metal in the pipe can also be promoted by constructing the pipe system of a highly heat conductive material. It is also preferred that the material of the pipe system have a lower melting point than that of the metal being processed in the furnace or container. Furthermore, it is also possible to decrease the pipe diameter of the convoluted pipe without fear of reducing the gas flow through the gas scavenger into the melt, as it would be the case in a gas conduit consisting of an ordinary pipe.

The connection between the gas conduit pipe of the gas scavenger and the pipe system can be carried out in an unusual manner suitable for such purposes, for instance by means of a screw or plug coupling.

As refractory materials for the construction of the fused base block, materials having high aluminum oxide contents are preferred, however, materials such as magnesium oxide, magnesium oxide-chromium ore, olivine [chrysolite], zirconium silicate, and others, may also be considered suitable.

It should be noted that as gas scavengers either bricks having a normally increased porosity, or bricks having a so-called directional porosity, that is, bricks in which a number of pores are aligned in a desired direction throughout the whole brick, may be used. To obtain a high durability, the bricks with a directional porosity have proven to be specially beneficial.

DESCRIPTION OF THE DRAWINGS

The invention is further explained with reference to the drawings, wherein two embodiments of the gas scavenger and their construction in a base block are illustrated.

DESCRIPTION OF THE PREFERRED EMBODIMENTS

Figure 1:
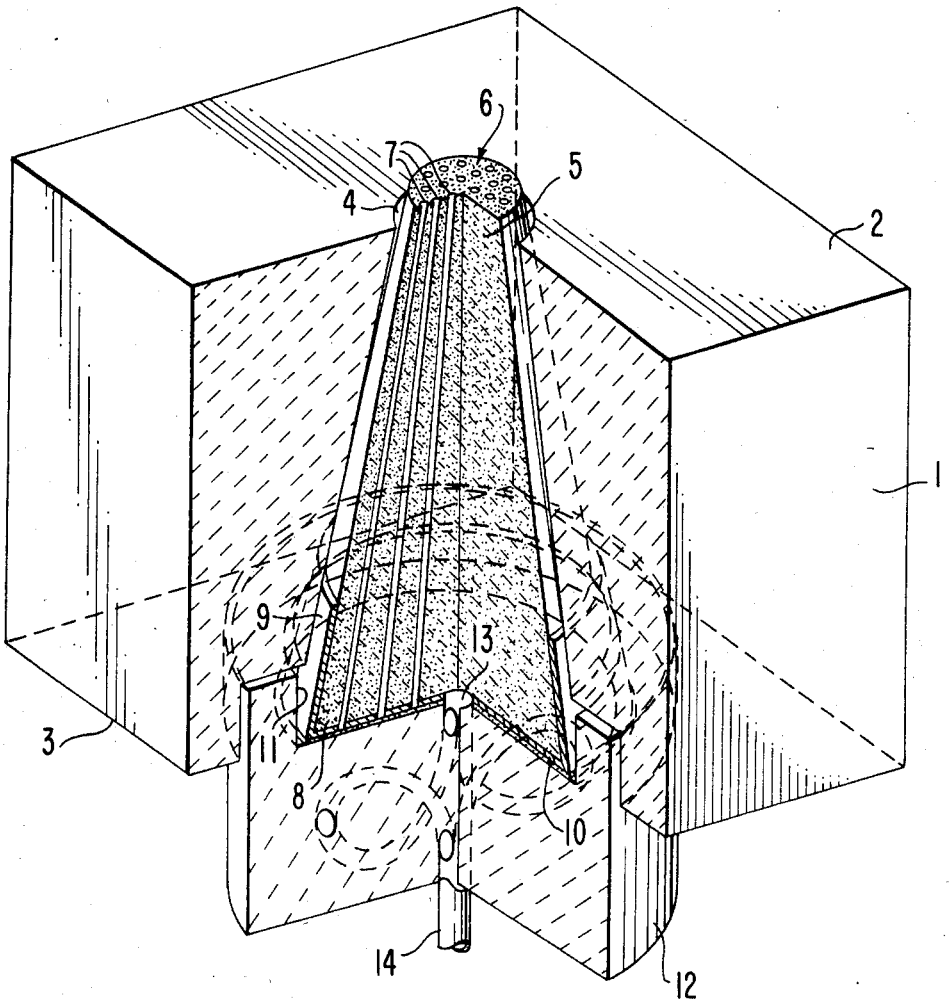
FIG. 1 is a cross-sectional view of a gas scavenger disposed in a ventilated brick with the brick in the form of a truncated cone.

The ventilated brick in FIG. 1 shows in its center a conically constructed portion 4 which is in the center of the ventilated brick. The brick 1 traverses from the hot brick end 2 (the surface on interior of the furnace or container) to the cold brick end 3. The conical portion 4 increases in width in the direction of the cold brick end 3. The ventilated brick 1 can, for instance, be disposed in the floor or side wall of a pig iron container, a pouring ladle, an intermediate container for continuously casting of steel, a converter, an electric arc furnace or a container for handling nonferrous metals, such as an aluminum melt furnace. The type of support for the ventilated brick 1 in the floor or the side wall of a refractory lining is not illustrated, since it is of no significance to the present invention. If desired, the ventilated brick 1 can be constructed to be easily changeable within the lining.

In the recess 4 of ventilated brick 1, there is a gas scavenger 5 in a shape of a truncated cone, which has so-called directional pores 7 besides the numerous irregular dispersed pores 6. The pores 7 are elongated in the longitudinal direction of the brick and serve to conduct the treatment gases into the melt. This gas scavenger 5 is provided with a metal sheet mantle 9 at its broader end 8, which covers the cold brick end laying on the outer side of the furnace or container. The mantle 9 covers the lower part of the conical surface and its bottom surface, that is, the scavenger lower face 10.

The gas scavenger 5 is placed (on its lower face 10) in a diagonally circular recess 11 of a base block 12 of refractory material. The recess totally encircles the lower face 10, and is fastened with mortar or cement to construct a labyrinth seal. The base block 12 shown in FIG. 1 has a cylindrical form, but can have any other suitable form, and for instance, can be a parallelepiped. The base block 12 in FIG. 1 is disposed in ventilated brick 1 in the recess 4 on the cold brick end 3, whereby the recess 4 is accordingly widened for this purpose.

The sheet metal mantle 9 on the scavenger lower face 10 is provided with a gas conduit pipe 13. With the aid of a winding or a plug coupling, the gas conduit pipe 13 is connected to a double, partially vertical traversing pipe system 14 for feeding gas to the gas scavenger 5 and through it to the molten metal to be processed.

As can be seen from FIG. 1, a breakthrough of the melt between the sheet metal mantle 9 of the gas scavenger 5 and the ventilated brick 1, or between the sheet metal mantle 9 and the gas scavenger 5, or through the gas scavenger 5 itself, is prevented by the base block 12. Further spreading of the melt or a possible ingress of the melt into the pipe system 14 is brought quickly to a halt in gas conduit pipe 13 through solidification.

Figure 2:
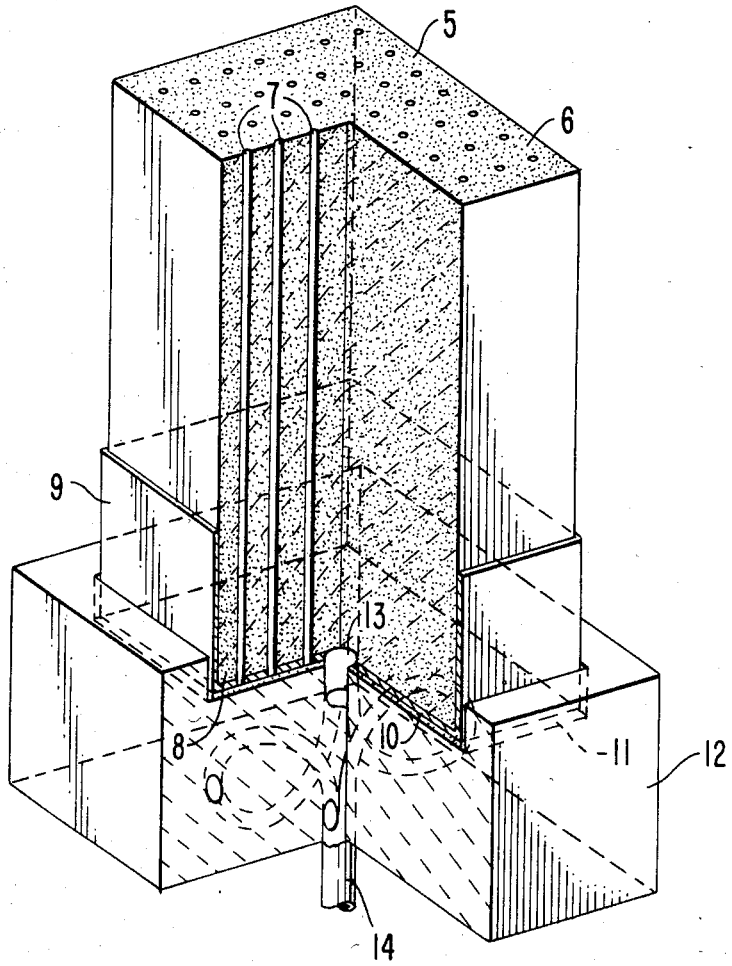
FIG. 2 also is a cross-sectional view of a parallelepipedial gas scavenger illustrated with the base block.

The embodiment illustrated in FIG. 2 shows similar parts with identical numerals to FIG. 1, whereby for reasons of simplicity illustration of the remainder of the ventilated brick was omitted. The difference of this embodiment as compared to FIG. 1 is in that the gas scavenger 5 is of rectilinear construction having a square cross section and accordingly recess 11 of base block 12 is also rectangular. The base block 12 itself is in this case is also of rectilinear construction. Like in FIG. 1, the gas scavenger 5 is a brick having directional porosity, and includes a sheet metal mantle 9 only at the brick cold end, and the scavenger lower face 10.

Within the scope of the invention various modifications in the construction of the gas scavenger are possible. For instance, the gas scavenger can have metal plates embedded therein; the sheet metal mantle may cover one or more of its side surfaces totally, or practically lay only on the scavenger's lower face; or encircle only a small part of the side surface bordering on the floor surface with a clamping action. In all cases the construction according to the invention provides for a longer life of the gas scavenger and, furthermore, a quick changing of the gas scavenger and the adherent base block.

What is claimed is:

1. An apparatus for introducing gas to molten metal, said apparatus comprising:
   (a) a refractory member having an opening therethrough;
   (b) a gas scavenger disposed to fit within said opening in said refractory member, said scavenger having a hot face in contact with said molten material and an opposite cold face, said scavenger including at least one gas conducting opening for transmitting gas from said cold face to said hot face;
   (c) a refractory base in contact with said cold face of said scavenger, said base including a recess for receiving the end of said scavenger having said cold face, said base further including gas conduit means comprised of a gas outlet in flow communication with the gas conducting opening in the cold face of said gas scavenger, a gas inlet and a pair of vertically disposed spiral conduits in flow communication with said gas outlet and said gas inlet.

2. The apparatus of claim 1 wherein said member is disposed within the bottom of said apparatus.

3. The apparatus of claim 2 wherein said apparatus comprises a portion of a container for molten metal.

4. The apparatus of claim 2 wherein said apparatus comprises a portion of a furnace.

5. The apparatus of claim 1 wherein said gas scavenger is a porous refractory material having pores aligned in the intended direction of gas flow said pores comprising the gas conducting openings of said gas scavenger.

6. The apparatus of claim 1 wherein said gas scavenger is in the form of a truncated cone with said hot face being the smaller of the opposite end faces of said conical gas scavenger.

7. The apparatus of claim 1 wherein said gas scavenger has a square cross section.

8. The apparatus of claim 1 wherein said gas scavenger is fastened to said base by means of refractory cement.

9. The apparatus of claim 1 wherein said gas scavenger is fastened to said base by means of refractory mortar.

10. The apparatus of claim 1 wherein said gas conduit is constructed of a highly heat conductive material.

11. The apparatus of claim 1 wherein said base includes metal conduits for said gas, said metal having a melting point below that of said molten metal.

12. The apparatus of claim 1 wherein said recess in said base forms a ridge around the outer peripheral edge of said base, said refractory member including a groove disposed to receive said ridge.

13. The apparatus of claim 12 wherein said recess, said cold face, said ridge and said groove form a labyrinth seal.

14. An apparatus for introducing gas to molten metal, said apparatus comprising:

(a) a refractory member having an opening therethrough and a groove surrounding said opening;

(b) a gas scavenger disposed to fit within said opening in said refractory member, said scavenger having a hot face in contact with said molten metal and an opposite cold face, said scavenger including at least one gas conducting opening for transmitting gas from said cold face to said hot face;

(c) a refractory base in contact with said cold face of said scavenger, said base including a recess for receiving the cold face of said scavenger, said recess forming an annular ridge around the outer peripheral edge of said base, said groove in said refractory member being disposed to receive said ridge, said base further including gas conduit means comprised of a gas outlet in flow communication with the gas conducting opening in the cold face of said gas scavenger, a gas inlet and a pair of vertically disposed spiral conduits in flow communication with said gas outlet and said gas inlet.

* * * * *